United States Patent [19]

Horn et al.

[11] 3,964,435

[45] June 22, 1976

[54] APPARATUS FOR COATING ELONGATED OBJECTS OF SMALL DIAMETER

[75] Inventors: Roy L. Horn, Philadelphia; M. Jack Lane, Langhorne, both of Pa.

[73] Assignee: H. C. Price Co., Bartlesville, Okla.

[22] Filed: Feb. 26, 1975

[21] Appl. No.: 553,245

[52] U.S. Cl. ..... 118/630; 198/131; 198/189

[51] Int. Cl.[2] ..... B05B 5/02

[58] Field of Search ..... 118/324, 630; 198/131, 198/198, 199, 189, 200, 247; 214/1 P

[56] References Cited

UNITED STATES PATENTS

| | | | |
|---|---|---|---|
| 967,040 | 2/1910 | McWane et al. | 214/1 P |
| 967,758 | 8/1910 | Goldman | 198/131 |
| 2,098,971 | 11/1937 | Perkins | 198/189 |
| 2,391,802 | 12/1945 | Shaw | 198/189 |
| 2,715,958 | 8/1955 | Lindstrom et al. | 198/131 |
| 3,021,939 | 2/1962 | Hopkins et al. | 198/131 |
| 3,323,934 | 6/1967 | Point | 118/630 |
| 3,687,706 | 8/1972 | Stanley et al. | 118/630 |

*Primary Examiner*—Louis K. Rimrodt
*Attorney, Agent, or Firm*—Lowe, Kokjer, Kircher, Wharton & Bowman

[57] ABSTRACT

Apparatus for conveying elongated objects of small diameter. After an object is coated with a protective coating, a first conveyor flight having a generally V-shaped groove receives the leading end of the object. A second conveyor flight has a generally U-shaped groove to be positioned in alignment with the object for receiving it if additional support is necessary, although generally remaining out of contact with the object. Another one of the aforedescribed first conveyor flights follows each of the aforedescribed second conveyor flights so that both ends of the object are normally supported by one of the first conveyor flights. In the event either end of the object misses one of the moving first conveyor flights, an adjacent second conveyor flight will receive the object and support it for movement. In a modified form of the invention the second conveyor flight having the U-shaped groove is eliminated and a second flight having a V-shaped groove which is removably inserted into the conveyor is utilized if needed.

12 Claims, 9 Drawing Figures

APPARATUS FOR COATING ELONGATED OBJECTS OF SMALL DIAMETER

This invention relates generally to conveyor apparatus and, more particularly, to apparatus for conveying objects of small diameter.

It has become the practice to coat reinforcing rods or "rebars" for concrete with a protective coating. This is particularly desirable for use in building bridges where the concrete is particularly subject to damage from chemicals used to melt snow and ice. It has been found that the life of the concrete is substantially prolonged by preventing the adverse affects of rusting steel in combination with deteriorating concrete.

It has heretofore been the practice to apply a protective coating to rebars by first fitting a number of rebars with end couplings and then passing them through an electrostatic spray station. The end couplings permit the coated rebars to be picked up by hooks and conveyed through a water quench and cooling station. The couplings are then removed and sent back to the electrostatic spray station along with the hooks which carry the coated rebars. The ends of the rebars which are covered by the couplings must be manually touched up to complete the coating procedure. It is not unusual during this coating procedure for a hot, freshly coated rebar to slip from the couplings which are holding it and fall to the ground. In some instances this may cause an adjacent rebar carried by the same coupling to also drop.

It is, therefore, a primary object of the present invention to provide apparatus for conveying objects of small diameter to which a coating has been freshly applied with minimum contact of the object, thereby reducing the amount of touch up required after the objects are removed from the conveyor.

Another one of the primary objects of this invention is to provide conveyor apparatus as described in the foregoing object wherein the elongated objects are supported both at their ends and at one or more points intermediate the ends so as to completely preclude any possibility of the object falling from the conveyor.

As a corollary to the above objects, an important aim of the invention is to provide, in one embodiment, conveyor apparatus wherein auxiliary supports are provided intermediate the ends of an elongated object but wherein these intermediate supports remain out of contact with the object during normal conveying if the additional support which they provide is not required.

Another important object of the invention is to provide, in an alternative embodiment, conveyor apparatus wherein removable auxiliary supports are adapted to be placed intermediate the ends of an elongated object only when needed with a minimal amount of time and effort.

Another one of the aims of this invention is to provide, in an alternative embodiment, conveyor apparatus as described in the foregoing object wherein the auxiliary conveyor flights are automatically ejected at the end of the conveyor after the elongated object being conveyed has been removed.

It is another very important objective of this invention to provide apparatus for conveying objects of small diameter wherein the objects are to be coated by an electrostatic spray procedure which accommodates a plurality of objects so as to permit more than one object to be sprayed simultaneously.

Still another one of the objectives of this invention is to provide apparatus for conveying objects of small diameter which are coated with a protective coating wherein the couplers and conveyor hooks heretofore used in moving the coated objects are completely eliminated.

It is also an aim of this invention to provide conveyor apparatus for objects of small diameter which are to be coated with an electrostatic coating apparatus wherein a superior coating is achieved as a result of the capability of conveying two or more coated objects simultaneously thus achieving a more uniform coating in the spray chamber and reducing the amount of powder coating which must be recycled through the chamber.

Other objects of the invention will be made clear or become apparent from the following description and claims when read in light of the accompanying drawings wherein:

Figure 9:
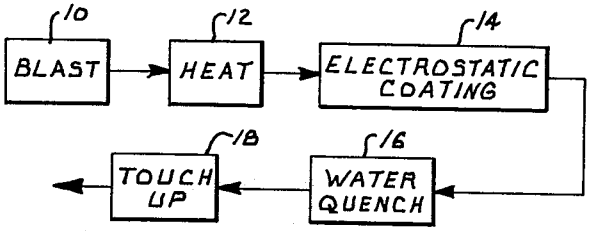
FIG. 9 is a flow diagram illustrating the steps in coating a rebar with a protective coating.

Initially referring to FIG. 9, any metallic object to be coated is normally first subjected to an abrasive cleaning in a blasting station 10. The object is then moved to a heating station or oven 12 where it is brought to a temperature adequate for the subsequent coating step. An electrostatic spray chamber 14 is utilized to apply the powdered coating and when the object emerges from the coating chamber it is conveyed to a water quench station 16 where it is cooled to approximately room temperature. Finally, a touch up station 18 is provided where manual laborers touch up any areas which have been damaged as the coated object is conveyed during the cooling process.

Figure 1:
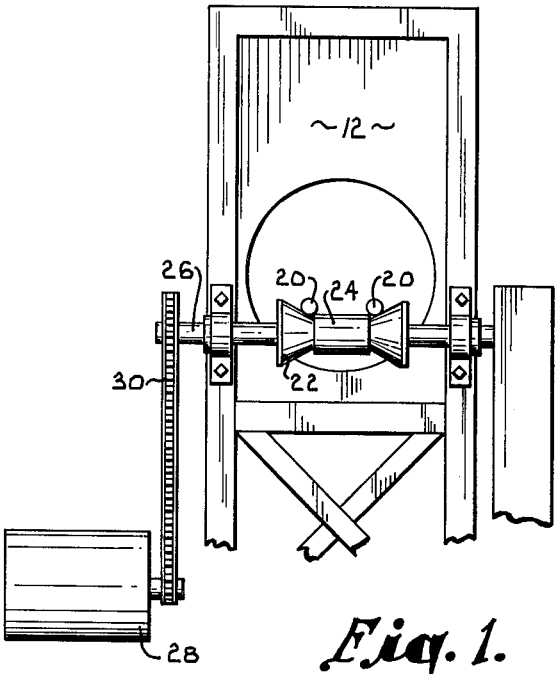
FIG. 1 is an elevational view of an oven used to dry rebars prior to coating of the same.

Referring now to FIG. 1, it is seen that a pair of elongated rebars 20 approximately 30 feet in length and having a diameter of three-eighths to five-eighths inch emerge from oven 12 and are separated into parallel, closely aligned relationship. The rebars 20 are fed onto a roller 22 which is provided with a collar 24 for maintaining the rebars in spaced relationship. Roller 22 is mounted on a shaft 26 which is driven by a motor 28 through a drive chain and sprocket assembly designated by the numeral 30.

Figure 2:
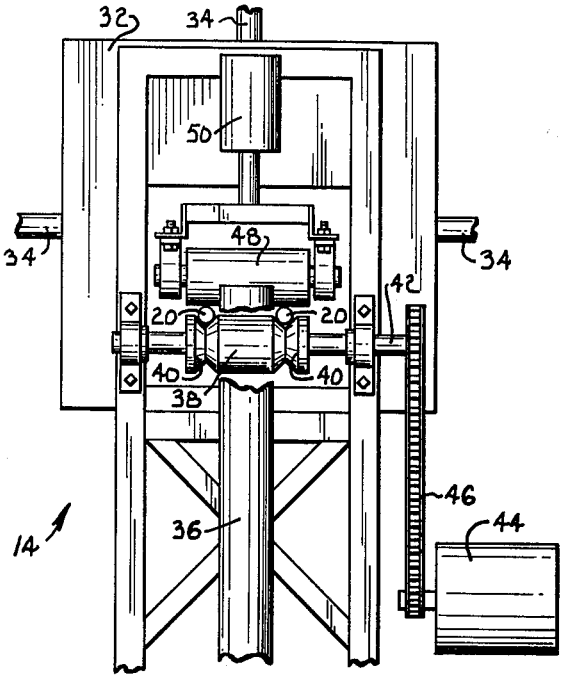
FIG. 2 is an elevational view of an electrostatic spray station with a pair of rebars being conveyed through it.
Figure 3:
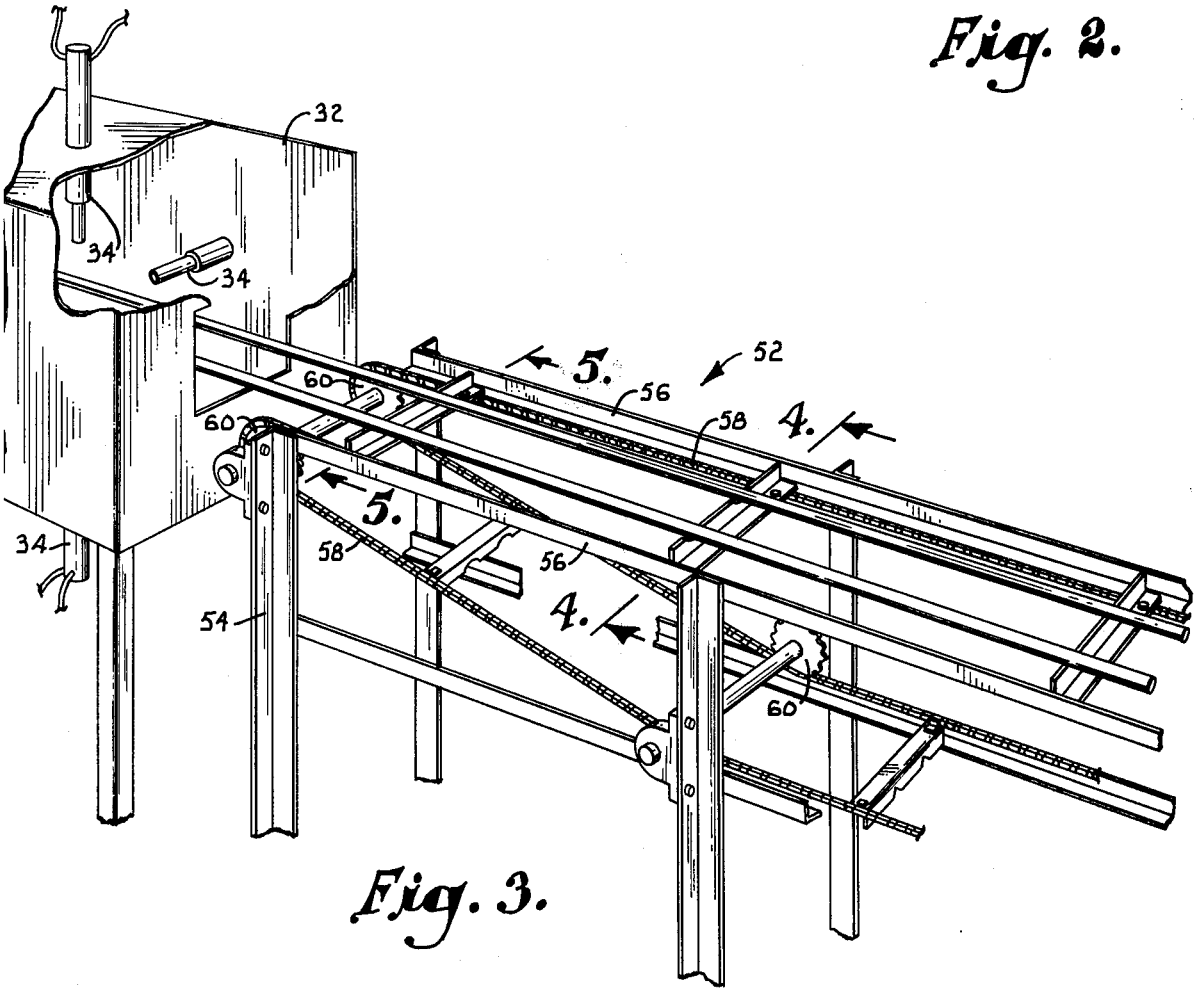
FIG. 3 is a perspective view of the electrostatic spray chamber and the conveyor which receives coated rebars as the emerge from the chamber.
Figure 6:
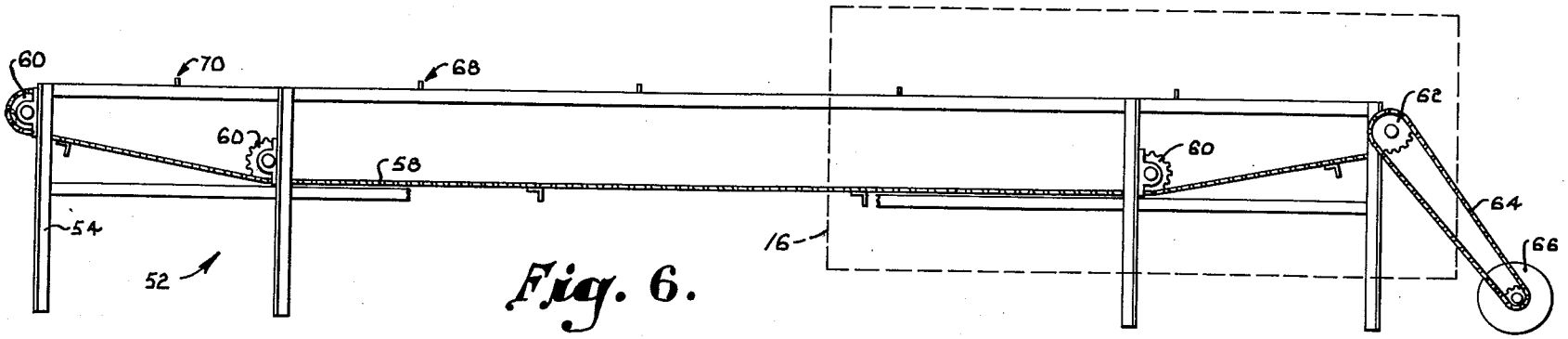
FIG. 6 is a partially schematic view of the conveyor apparatus with a water quench station being represented by broken lines.

Referring additionally to FIGS. 2 and 3, electrostatic spray chamber 14 comprises a housing 32 with spray guns 34 disposed at 90° angles on each side of the housing.

Referring particularly now to FIG. 2, an upright separator post 36 is disposed intermediate oven 12 and chamber 14 so as to maintain rebars 20 in spaced relationship. A roller 38 immediately in front of chamber 14 has spaced apart parallel grooves 40 adapted to receive rebars 20. Roller 38 is mounted on a shaft 42 which is driven by a motor 44 through a chain and sprocket assembly 46.

To assure positive forward movement of the rebars, a solid cylinder 48 is rotatably mounted immediately above roller 38 and is reciprocable between raised and lowered positions through utilization of a power cylinder 50. Thus, cylinder 50 may be extended to lower cylinder 48 into contact with rebars 20 resting on roller 38.

Figure 5:
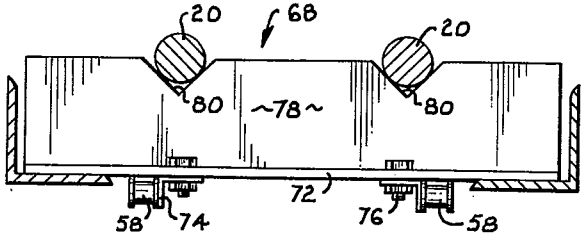
FIG. 5 is a horizontal, cross-sectional view on an enlarged scale, taken along line 5—5 of FIG. 3 and illustrating the other type of conveyor flight.
Figure 4:
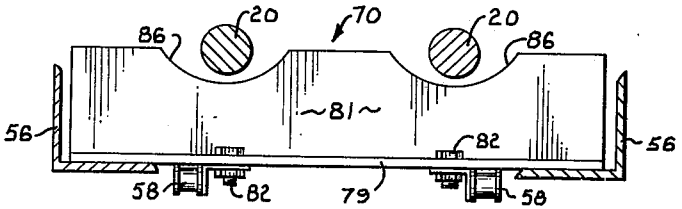
FIG. 4 is a horizontal, cross-sectional view on an enlarged scale, taken along line 4—4 of FIG. 3 and illustrating one of the conveyor flights.

Referring now to FIGS. 3, 4 and 5, apparatus for conveying rebars 20 after the latter have been coated with a protective coating in chamber 14 is designated generally by the numeral 52. Conveyor 52 comprises a framework 54 having longitudinally extending angle iron members 56 disposed in opposed relationship at the top of the framework 54 to present a pair of tracking surfaces. Two longitudinally extending, continuous conveyor chains 58 are disposed in parallel along the length of framework 54 and are trained around idler sprockets 60 disposed at opposite ends of the framework 54. A plurality of drive sprockets 62 are also provided at one end of framework 54 and a drive chain 64 drives the chains 58 through sprockets 62 and a motor 66.

Coupled with chains 58 are a plurality of first conveyor flights 68 and a plurality of second conveyor flights 70. Each of the first conveyor flights 68 is a generally L-shaped angle iron having one leg 72 disposed flat against chains 58 and providing means for coupling the flights to the chains through brackets 74 and nut and bolt assemblies 76. A second leg 78 extends upwardly away from chains 58 in generally perpendicular relationship thereto and presents aligned, parallel, spaced apart, generally V-shaped grooves 90 along its uppermost terminal edge.

Each of the second conveyor flights 70 is generally similar and is presented by an L-shaped angle iron having a first leg 79 disposed against chains 58 and presents means for securing the flights to the chains through brackets 84 and nut and bolt assemblies 82. A second leg 81 extends upwardly away from chains 58 in generally perpendicular relationship thereto with a pair of generally concave, U-shaped, side-by-side, parallel grooves 86 disposed along the uppermost terminal edge.

In operation, the coated rebars 20 emerge from oven 12 and are positively fed into electrostatic spray chamber 14 by rollers 38 and cylinder 48. In the spray chamber, the charged particles are sprayed onto the heated rebars which are at a temperature sufficient to melt the coating material and make a uniform coating film. Because of the extremely small diameter of the rebars, relative to objects which are more normally coated using elctrostatic spray chamber, the chambers have not been designed to handle such small diameter objects. This has resulted in somewhat of an over supply of coating material which may adversely affect the uniformity and quality of the coating and in any case causes excess materials to be recycled through the equipment. By coating two or more objects at one time, however, the total surface coated is closer to that for which conventional electrostatic spray equipment is designed and the resulting coating is of highest quality while also reducing losses and wear on equipment as a result of a smaller quantity of powdered coating material being recycled through the equipment.

The coated rebars are received by conveyor 52 with the conveyor being started so that the leading end of the rebars 20 will be received by one of the first conveyor flights 68. Thus, the rebars are complementally received in V-shaped grooves 80 in the manner indicated in FIG. 5. The second conveyor flights 70 are disposed intermediate the first conveyor flights 68 and under normal operating conditions rebars 20 will be disposed in closely spaced relationship to U-shaped grooves 86. Thus, since the rebars do not actually contact these grooves, there is not damage done to the coating in this area. On the other hand, should the ends of the rebars 20 not be received by one of the first flights 68, the second flights 70 are available to provide additional support and prevent the rebars from dropping off of the conveyor. The same is true at the opposite end of the rebars which normally will be supported by one of the first flights 68.

As rebars 20 are moved along the length of conveyor 52, the protective coating cools and is ultimately passed through the water quench station 16 wherein it is completely cured and cooled to approximately room temperature. The rebars may then be removed from the conveyor and a laborer will touch up those areas which have been in contact with first conveyor flights 68. The conveyor flights pass along the bottom of framework 54 is an inverted position and are returned upright ready to receive another rebar as the end of the framework adjacent chamber 14 is reached. Even though the step of manually touching up the rebars is not completely eliminated by the present invention, the total area to be touched up is substantially less than is the case when the end couplers heretofore described are utilized. In addition, since two or more rebars may be coated at one time, the overall production represents a twofold increase over the techniques of the prior art. In addition, a higher quality coating is obtained without taxing the electrostatic spray equipment to as great a degree as is the case when only a single rebar is coated. Furthermore, the delays heretofore caused by rebars falling from the conveyor have been completely eliminated with the apparatus of the present invention.

Figure 8:
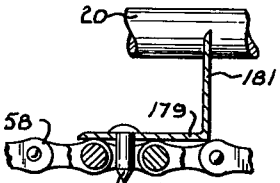
FIG. 8 is a vertical cross-sectional view taken along line 8—8 of FIG. 7.
Figure 7:
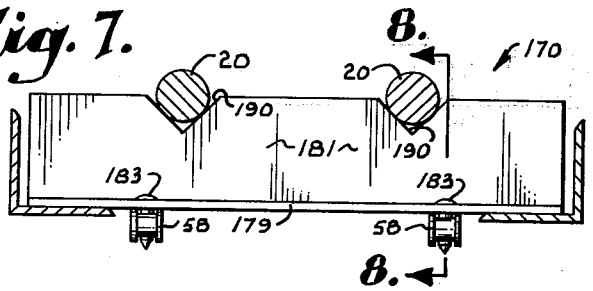
FIG. 7 is a horizontal cross-sectional view on an enlarged scale, similar to FIG. 5, and illustrating an alternative form of the invention.

In the modified form of the invention shown in FIGS. 7 and 8 a modified second conveyor flights is designated generally by the numeral 170. Conveyor flight 170 comprises a generally L-shaped angle iron having a first normally horizontal leg 179 with rigid pins 183 depending from the leg and extending through chain 58. An upright leg 181 extends upwardly away from chains 58 in generally perpendicular relationship thereto and has a pair of aligned, parallel spaced apart generally V-shaped grooves 190 along its uppermost terminal edge.

In utilizing the modified form of the invention second conveyor flights 81 are omitted thus leaving first conveyor flights 78 in spaced relationship along the elongated object. The spacing of first conveyor flights 78 is selected so that a minimal number will be required to support an object of a particular length. In the event sagging of the object occurs and it is apparent to an operator that additional support will be needed intermediate flights 78, one of flights 170 may quickly be inserted into chains 58 beneath the object such as rebar 20 as illustrated in FIGS. 7 and 8. When the rebars reach the end of the conveyor and are removed flight 170 will drop out of chains 58 as the conveyor flights pass along the bottom of framework 54 in their inverted positions as described above. This embodiment of the invention is preferred where it is desired to eliminate any possibility of the objects being coated touching the supporting conveyor flights unnecessarily and thus damaging the coating requiring additional touch up. It has been found that as few as three conveyor flights may be utilized to suppport two rebars up to 50 feet in length.

While the invention has been particularly described with reference to the application of protective coatings to rebars and the conveying of such objects, it is to be understood that the invention will find application wherever the handling of objects of relatively small diameter with minimum contact is an objective. For example, it is contemplated that the apparatus will find utilization in the coating of small diameter pipe and in the handling of certain types of extruded plastic materials. In any application where the elongated object is characterized by undergoing a degree of flexure along its length when supported only at its ends, the present invention will offer substantial advantages over prior known conveying techniques.

Having thus described the invention, we claim:

1. Structure for conveying an elongated object of small diameter, said structure comprising:
- closed conveyor means adapted for movement;
- a power source coupled with said conveyor means for moving the latter;
- a plurality of first flights coupled with said conveyor means in spaced apart relationship,
- each of said first flights presenting a first groove for contiguously receiving said object in supporting relationship and
- a second conveyor flight coupled with said conveyor means intermediate said first flight,
- said second flight presenting a second groove which is normally disposed in spaced relationship to said object when the latter is supported by said first grooves, while also being adapted to receive said object in supporting relationship.

2. The invention of claim 1, wherein each of said first flights presents a plurality of said grooves in side-by-side relationship for conveying a plurality of said objects in side-by-side relationship.

3. The invention of claim 1, wherein said first grooves are generally V-shaped in cross section.

4. The invention of claim 1, wherein said object is coated with a protective coating prior to being received by said first flights.

5. The invention of claim 4, wherein is included means for applying a protective coating to said object.

6. The invention of claim 5, wherein each of said first flights presents two side-by-side grooves for conveying two of said objects in side-by-side relationship.

7. The invention of claim 6, where the means for applying a coating comprises an electrostatic spray chamber and including means for guiding said objects into said chamber in spaced relationship corresponding to the spacing between said side-by-side grooves for alignment with the latter as said objects leave said chamber.

8. The invention of claim 1, wherein a plurality of both said first and second flights are disposed along the length of said conveyor means.

9. The invention of claim 1, wherein said second grooves are generally U-shaped in cross section.

10. Structure for conveying an elongated object of small diameter, said structure comprising:
- closed conveyor means adapted for movement;
- a power source coupled with said conveyor means for moving the latter;
- a plurality of first flights coupled with said conveyor means in spaced apart relationship,
- each of said first flights presenting a first groove for contiguously receiving said object in supporting relationship; and
- a second conveyor flight adapted to be releasably coupled with said conveyor intermediate said first conveyor flights and presenting a second groove adapted to receive said object in supporting relationship.

11. The invention of claim 10, wherein said second groove is of generally V-shaped cross section.

12. The invention of claim 11, wherein said conveyor comprises a conveyor chain and wherein said second flight includes pin means received in one of the links of said chain.

* * * * *